US008820714B2

(12) United States Patent
Shih

(10) Patent No.: US 8,820,714 B2
(45) Date of Patent: Sep. 2, 2014

(54) SLEEVE DRIVING STRUCTURE FOR VARIOUS EASY JACKS

(76) Inventor: Leo Shih, Taichung (TW)

( * ) Notice: Subject to any disclaimer, the term of this patent is extended or adjusted under 35 U.S.C. 154(b) by 247 days.

(21) Appl. No.: 13/615,364

(22) Filed: Sep. 13, 2012

(65) Prior Publication Data

US 2014/0070501 A1 Mar. 13, 2014

(51) Int. Cl.
*B66F 3/12* (2006.01)

(52) U.S. Cl.
USPC ..... 254/126

(58) Field of Classification Search
USPC ..... 254/122, 126; 81/176.1, 124.2, 180.1; 187/211
See application file for complete search history.

(56) References Cited

U.S. PATENT DOCUMENTS

| | | | | |
|---|---|---|---|---|
| 5,876,526 | A * | 3/1999 | Hamade et al. | 152/416 |
| 5,950,990 | A * | 9/1999 | Castillo | 254/126 |
| 6,695,289 | B1 * | 2/2004 | Mickael | 254/122 |
| 2001/0045550 | A1 * | 11/2001 | Reilly et al. | 254/376 |
| 2005/0109996 | A1 * | 5/2005 | Razzaghi | 254/126 |

* cited by examiner

*Primary Examiner* — David B Thomas

(57) ABSTRACT

A sleeve driving structure for various easy jacks contains: a sleeve body including a polygonal fitting portion formed in a first end thereof for fitting with a rotating tool and including a first connecting extension and a second connecting extension symmetrically extending outward from a second end thereof, the first connecting extension and the second connecting extension being parallel to and separated from each other so as to insert at least one driving piece of a screw rod of a jack, and the first connecting extension and the second connecting extension having a first orifice and a second orifice symmetrically communicating and concentric with each other and defined in a first direction thereof; a bolt body fitted in the first orifice and the second orifice of the first connecting extension and the second connecting extension and at least one aperture of the at least one driving piece of the jack.

9 Claims, 17 Drawing Sheets

SLEEVE DRIVING STRUCTURE FOR VARIOUS EASY JACKS

FIELD OF THE INVENTION

The present invention relates to sleeve driving structure for various easy jacks to fit with a power rotating tool or a manual rotating tool by which various easy jacks are driven to move upwardly or downwardly.

BACKGROUND OF THE INVENTION

A conventional easy jack is used to replace a new tire of vehicles.

As shown in FIG. 1-1, a first type of easy jack 10 with a single driving piece 12 formed on an end portion of a screw rod 11, and a thickness of the single driving piece 12 is 8 mm, the single driving piece 12 includes an aperture 121 defined thereon. As illustrated in FIG. 1-2, in the operation of the easy jack 10, a hook portion 131 of a fit post 13 is hooked with the aperture 121 of the single driving piece 12, and a flat portion 132 of the fit post 13 is horizontally fitted into a through slot 141 of a rotary stem 14 so that the rotary stem 14 is rotated to drive the fit post 13 to rotate the screw rod 11 by which the easy jack 10 is driven to move upwardly or downwardly, however such an operation has the following defects:

1. The hook portion 131 of the fit post 13 is hooked with the aperture 121 of the single driving piece 12, so a central axis line of the fit post 13 offsets from a central line of the screw rod 11, hence when rotating the rotary stem 14, a user has to holds the fit post 13 by one hand and rotates the rotary stem 14 by the other hand, thus having an inconvenient operation.

2. Due to the flat portion 132 of the fit post 13 is horizontally fitted into the through slot 141 of the rotary stem 14, so the easy jack 10 can be only driven manually.

To improve above-mentioned problems, an improved sleeve for matching with a power rotating tool is developed as shown in FIG. 1-3. The sleeve includes a sleeve body 20, and the sleeve body 20 has a polygonal fitting portion 201 (i.e., an inner fitting hole) formed on a first end thereof to fit with a power rotating tool 21 (such as a pneumatic gun) and has a recess 202 defined on a second end thereof and corresponding to the single extending piece 12 of the screw rod 11, such that the sleeve body 20 connects with the single extending piece 12 of the screw rod 11, and the fitting portion 121 is fitted with the power rotating tool 21 to drive the easy jack 10 to move upwardly or downwardly.

As shown in FIG. 2-1, a second type of easy jack 30 includes two driving pieces 32, 33 formed on an end portion of a screw rod 31, and a distance between the two driving pieces 32, 33 is 20-22 mm, the two driving pieces 32, 33 have two symmetrical apertures 321, 331 defined thereon and communicating and concentric with each other. As illustrated in FIG. 2-2, in the operation of the easy jack 30, the hook portion 131 of the fit post 13 is hooked with the two apertures 321, 331 of the two driving pieces 32, 33, and the flat portion 132 of the fit post 13 is horizontally fitted into the through slot 141 of the rotary stem 14 so that the rotary stem 14 is rotated to drive the fit post 13 to rotate the screw rod 31 by which the easy jack 30 is driven to move upwardly or downwardly, however such an operation has the same defects as those of the first type of easy jack 10.

To overcome above-mentioned defects, an improved sleeve for matching with the power rotating tool 21 is invented as shown in FIG. 2-3. The sleeve includes a sleeve body 40, and the sleeve body 40 has a polygonal fitting portion 401 (i.e., an inner fitting hole) formed on a first end thereof to fit with the power rotating tool 21 (such as the pneumatic gun) and has an extension 402 with a 20-22 mm of thickness, the extension 402 has two balls 403, 403 fixed on two side surfaces thereof, an outermost side distance between the two balls 403, 404 are equal to two diameters of the two symmetrical apertures 321, 331 of the two driving pieces 32, 33, such that the extension 402 is inserted between the two driving pieces 32, 33, and the two balls 403, 404 are limited in the two symmetrical apertures 321, 331 so that the sleeve body 40 is connected with the two driving pieces 32, 33, and the fitting portion 401 is fitted with the power rotating tool 21 to drive the easy jack 30 to move upwardly or downwardly.

Referring further FIG. 3-1, a third type of easy jack 50 includes another two driving pieces 52, 53 formed on an end portion of a screw rod 51, and a distance between the two driving pieces 52, 53 is 16 mm, the two driving pieces 52, 53 have two symmetrical apertures 521, 531 defined thereon and communicating and concentric with each other. As illustrated in FIG. 3-2, in the operation of the easy jack 50, the hook portion 131 of the fit post 13 is hooked with the two apertures 521, 531 of the two driving pieces 52, 53, and the flat portion 132 of the fit post 13 is horizontally fitted into the through slot 141 of the rotary stem 14 so that the rotary stem 14 is rotated to drive the fit post 13 to rotate the screw rod 31 by which the easy jack 50 is driven to move upwardly or downwardly. An improved sleeve for matching with the power rotating tool is invented as shown in FIG. 3-3. the sleeve includes a sleeve body 60, and the sleeve body 60 has a polygonal fitting portion 601 (i.e., an inner fitting hole) formed on a first end thereof to fit with the power rotating tool 21 (such as the pneumatic gun) and has an extension 602 with a 16 mm of thickness, the extension 602 has two ball fixed on two side surfaces thereof, and an outermost side distance between the two balls are equal to two diameters of the two symmetrical apertures 521, 531 of the two driving pieces 52, 53, such that the extension 602 is inserted between the two driving pieces 52, 53, and the two balls are limited in the two symmetrical apertures 521, 531 so that the sleeve body 60 is connected with the two driving pieces 52, 53, and the fitting portion 601 is fitted with the power rotating tool 21 to drive the easy jack 50 to move upwardly or downwardly.

Nevertheless, when the first type of easy jack, the second type of easy jack, and the third type of easy jack are driven by the power rotating tool, different sleeves have to be used to connect with the power rotating tool and to drive the first type of easy jack, the second type of easy jack, and the third type of easy jack, thus having troublesome operation.

The present invention has arisen to mitigate and/or obviate the afore-described disadvantages.

SUMMARY OF THE INVENTION

The primary object of the present invention is to provide a sleeve driving structure for various easy jacks which allows matching with a first type of easy jack with a single driving piece, a second type of easy jack with two driving pieces, or a third type of easy jack with another two driving pieces so that various easy jacks are driven by a power rotating tool or a manual rotating tool to move upwardly or downwardly.

Another object of the present invention is to provide a sleeve driving structure for various easy jacks in which a central axis line of a sleeve body connects with a central axis lines of the screw rods of the various easy jacks, thus operating the sleeve body stably.

To obtain the above objective, sleeve driving structure for various easy jacks provided by the present invention contains:

a sleeve body including a polygonal fitting portion formed in a first end thereof so as to fit with a rotating tool and including a first connecting extension and a second connecting extension symmetrically extending outward from a second end thereof, the first connecting extension and the second connecting extension being parallel to and separated a suitable distance from each other so as to insert at least one driving piece of a screw rod of a jack, and the first connecting extension and the second connecting extension having a first orifice and a second orifice symmetrically communicating and concentric with each other and defined in a first direction thereof;

a bolt body fitted in the first orifice and the second orifice of the first connecting extension and the second connecting extension and at least one aperture of the at least one driving piece of the jack.

The foregoing, as well as additional objects, features and advantages of the invention will be more readily apparent from the following detailed description, which proceeds with reference to the accompanying drawings.

BRIEF DESCRIPTION OF THE DRAWINGS

FIG. 1-2 is a perspective view of the conventional first type of easy jack being driven by a manual rotating tool.

FIG. 1-3 is a perspective view of the conventional first type of easy jack being driven by a power rotating tool.

FIG. 2-1 is a perspective view of a conventional second type of easy jack.

FIG. 2-2 is a perspective view of the conventional second type of easy jack being driven by a manual rotating tool.

FIG. 2-3 is a perspective view of the conventional second type of easy jack being driven by a power rotating tool.

FIG. 3-1 is a perspective view of a conventional third type of easy jack.

FIG. 3-2 is a perspective view of the conventional third type of easy jack being driven by a manual rotating tool.

FIG. 3-3 is a perspective view of the conventional third type of easy jack being driven by a power rotating tool.

DETAILED DESCRIPTION OF THE PREFERRED EMBODIMENTS

Figure 1:
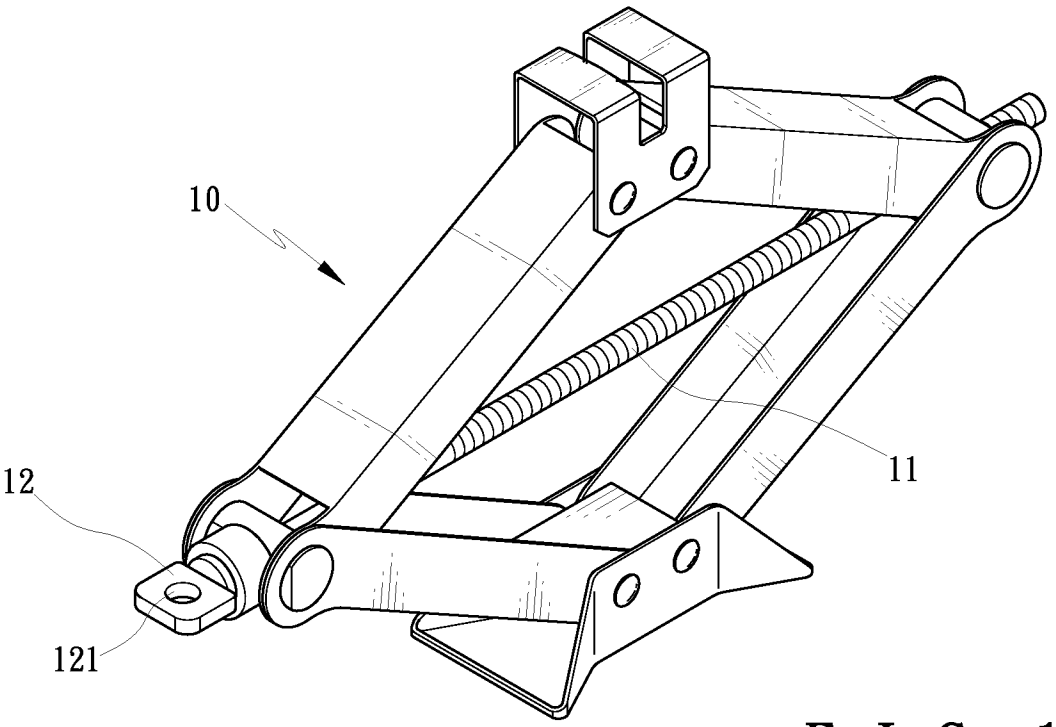
FIG. 1-1 PRIOR ART
FIG. 1-1 is a perspective view of a conventional first type of easy jack.
Figures 1, 2:
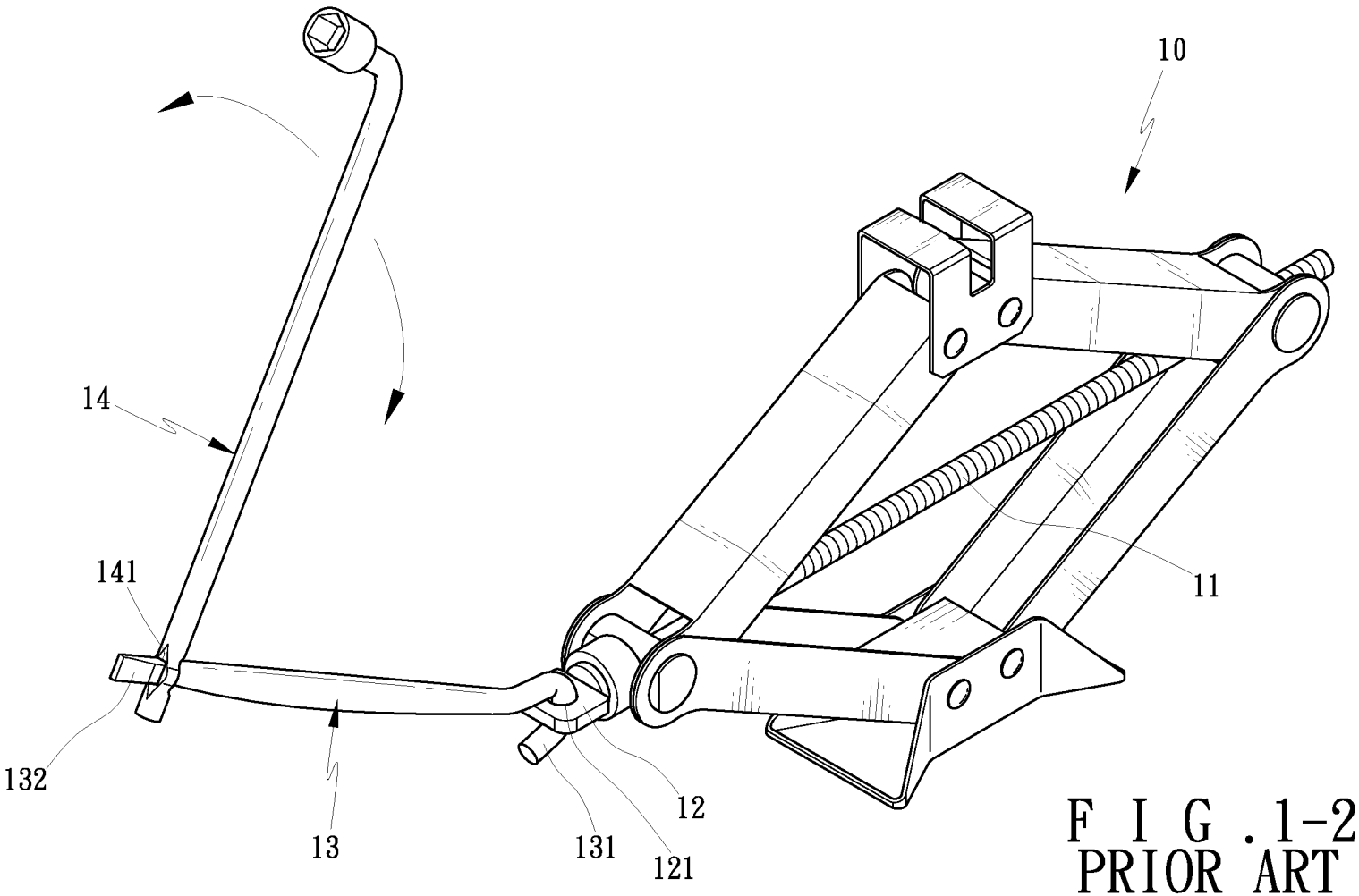
FIG. 1-2 PRIOR ART
Figures 1, 2, 3:
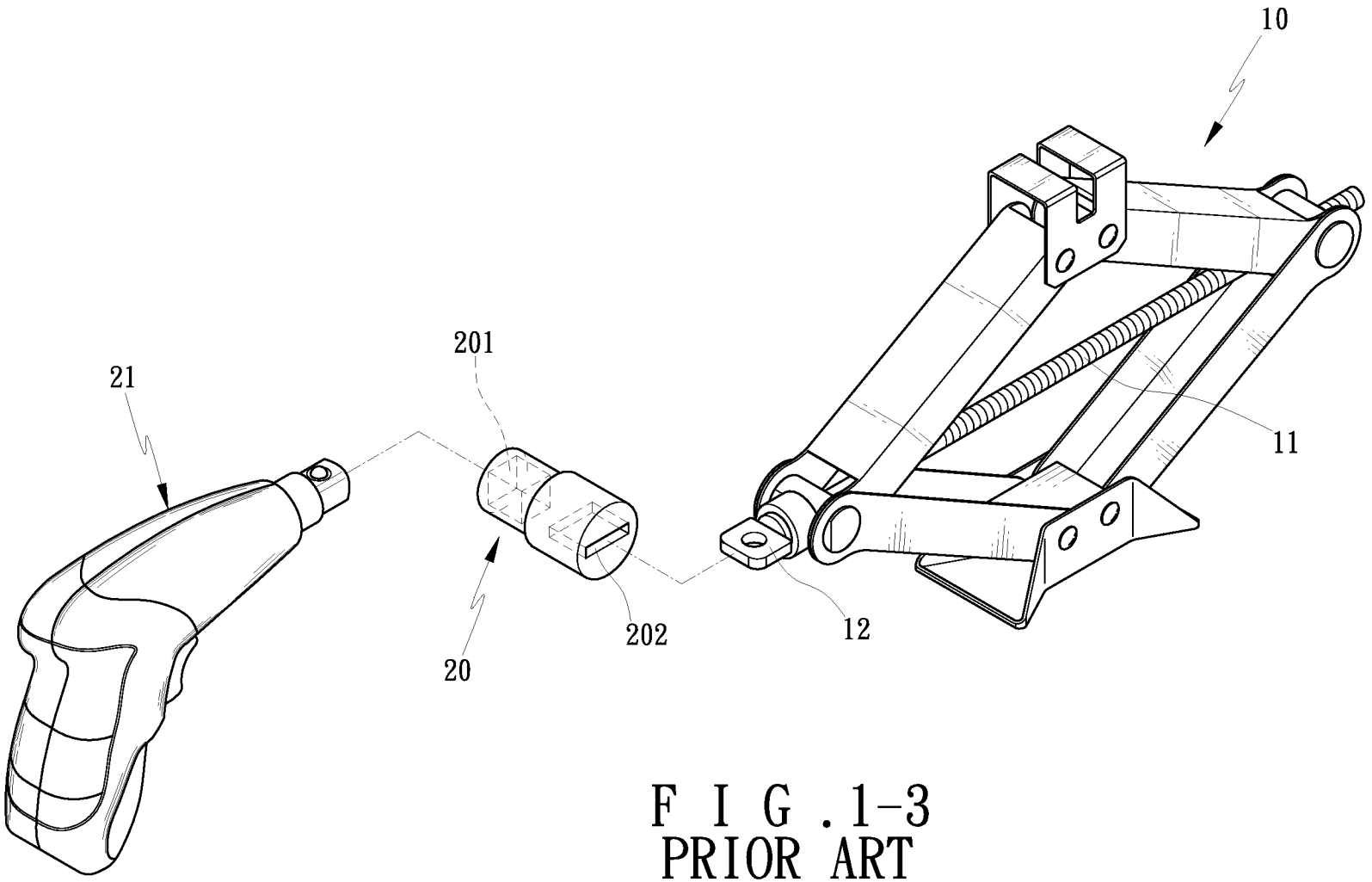
FIG. 1-3 PRIOR ART
Figures 1, 2:
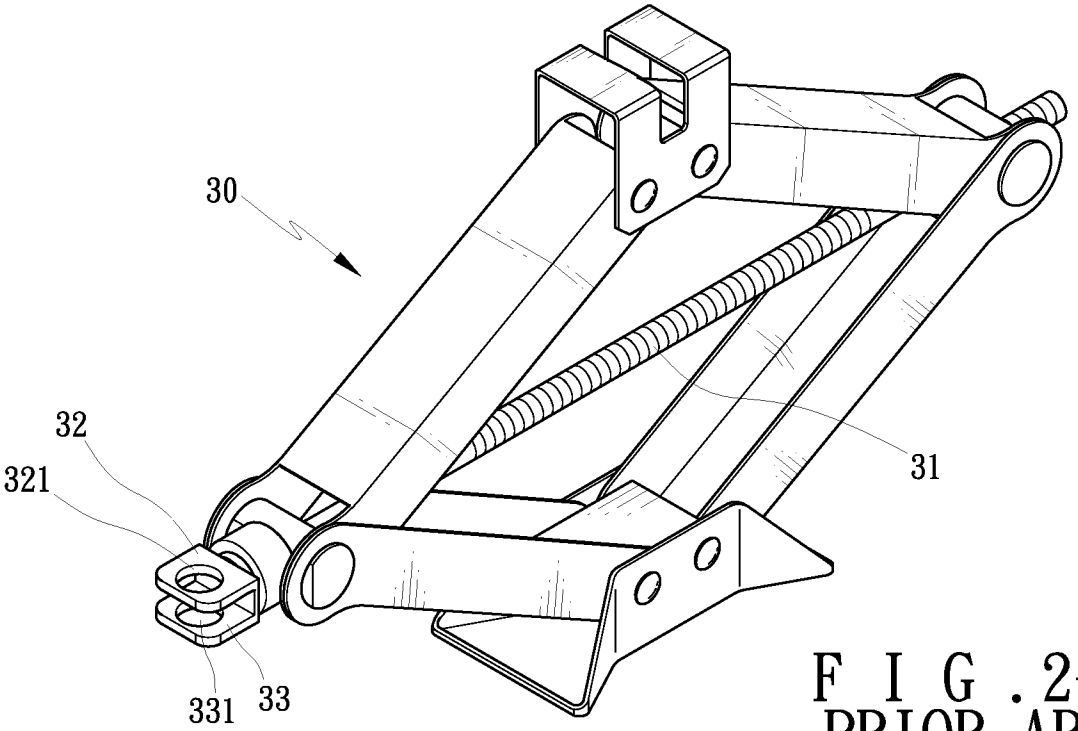
FIG. 2-1 PRIOR ART
Figure 2:
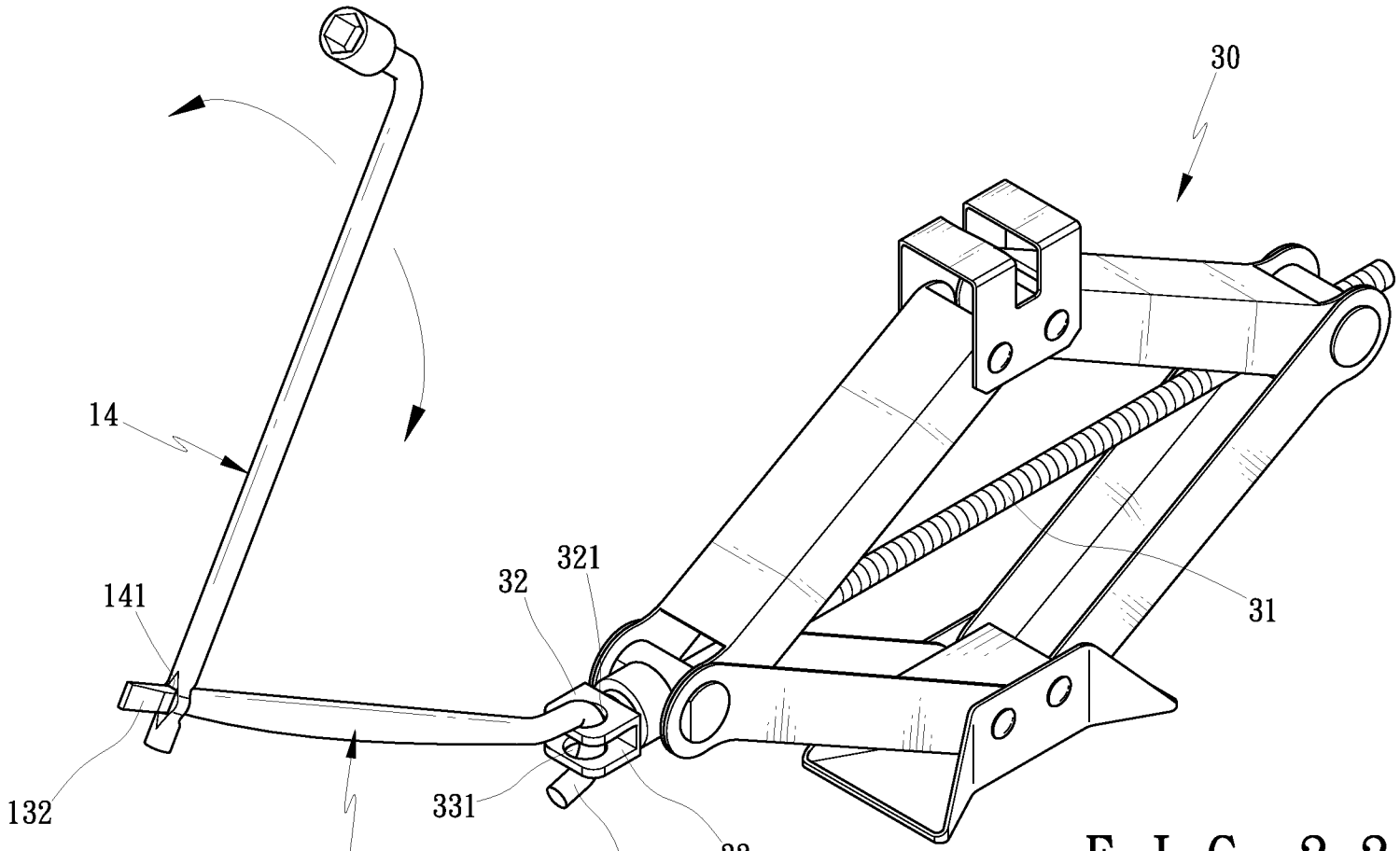
FIG. 2-2 PRIOR ART
Figures 2, 3:
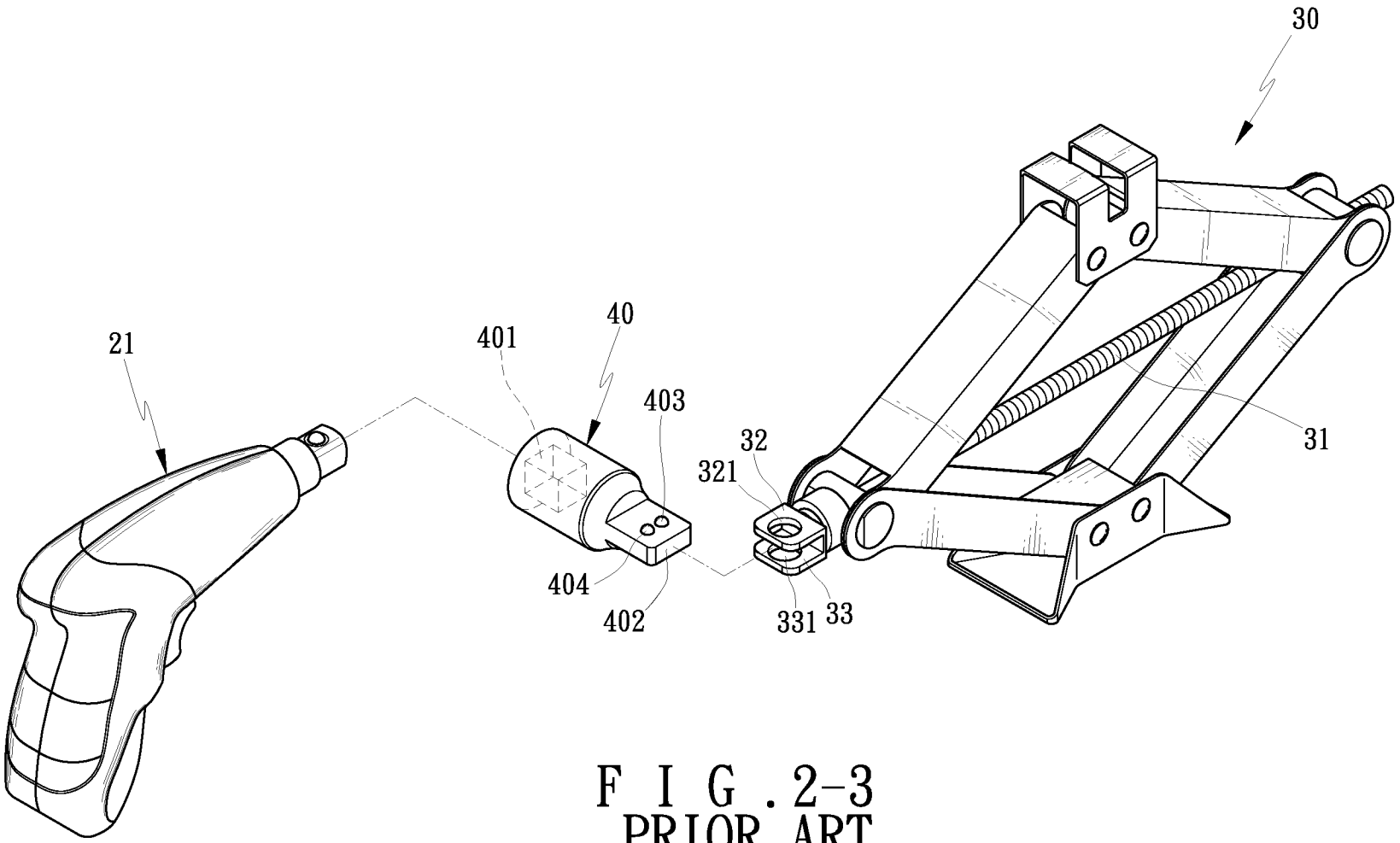
FIG. 2-3 PRIOR ART
Figures 1, 3:
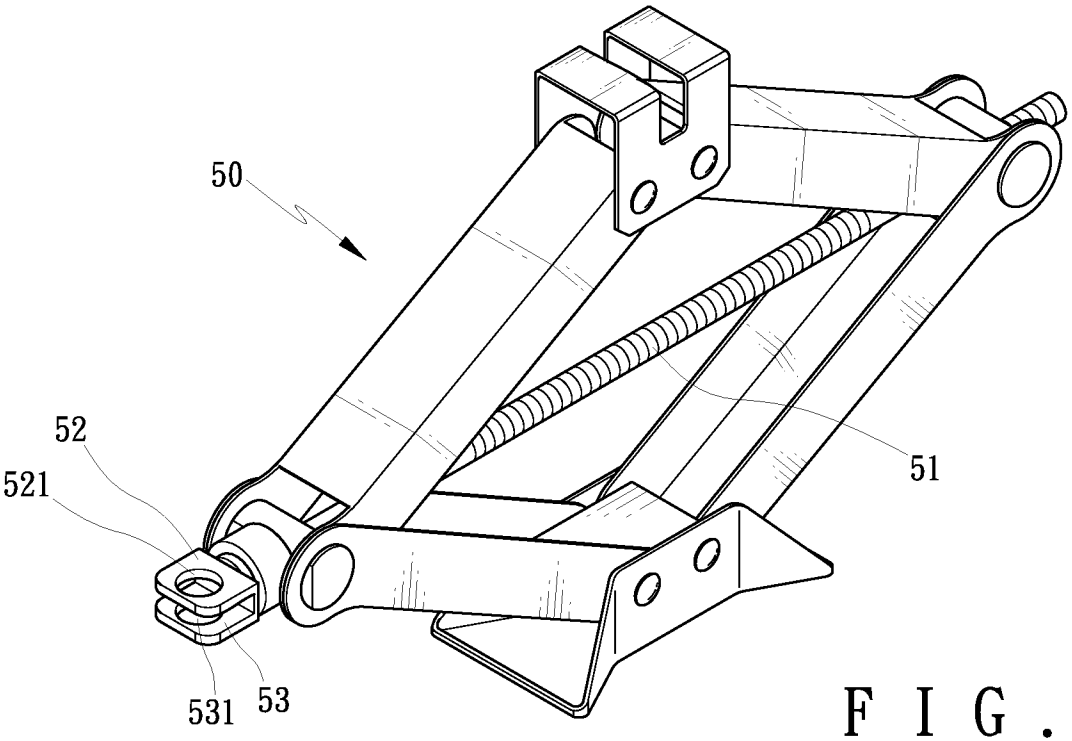
FIG. 3-1 PRIOR ART
Figures 2, 3:
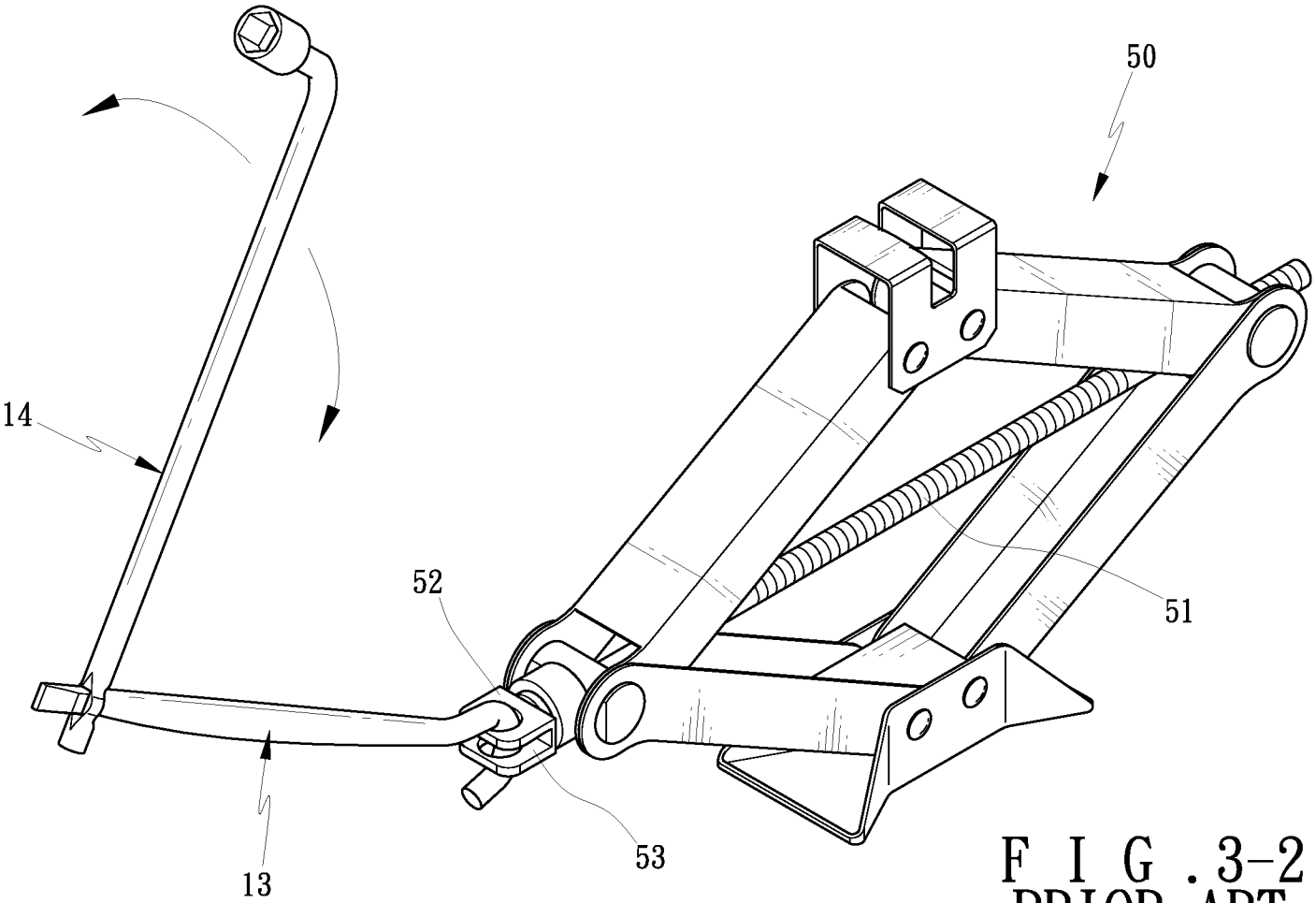
FIG. 3-2 PRIOR ART
Figure 3:
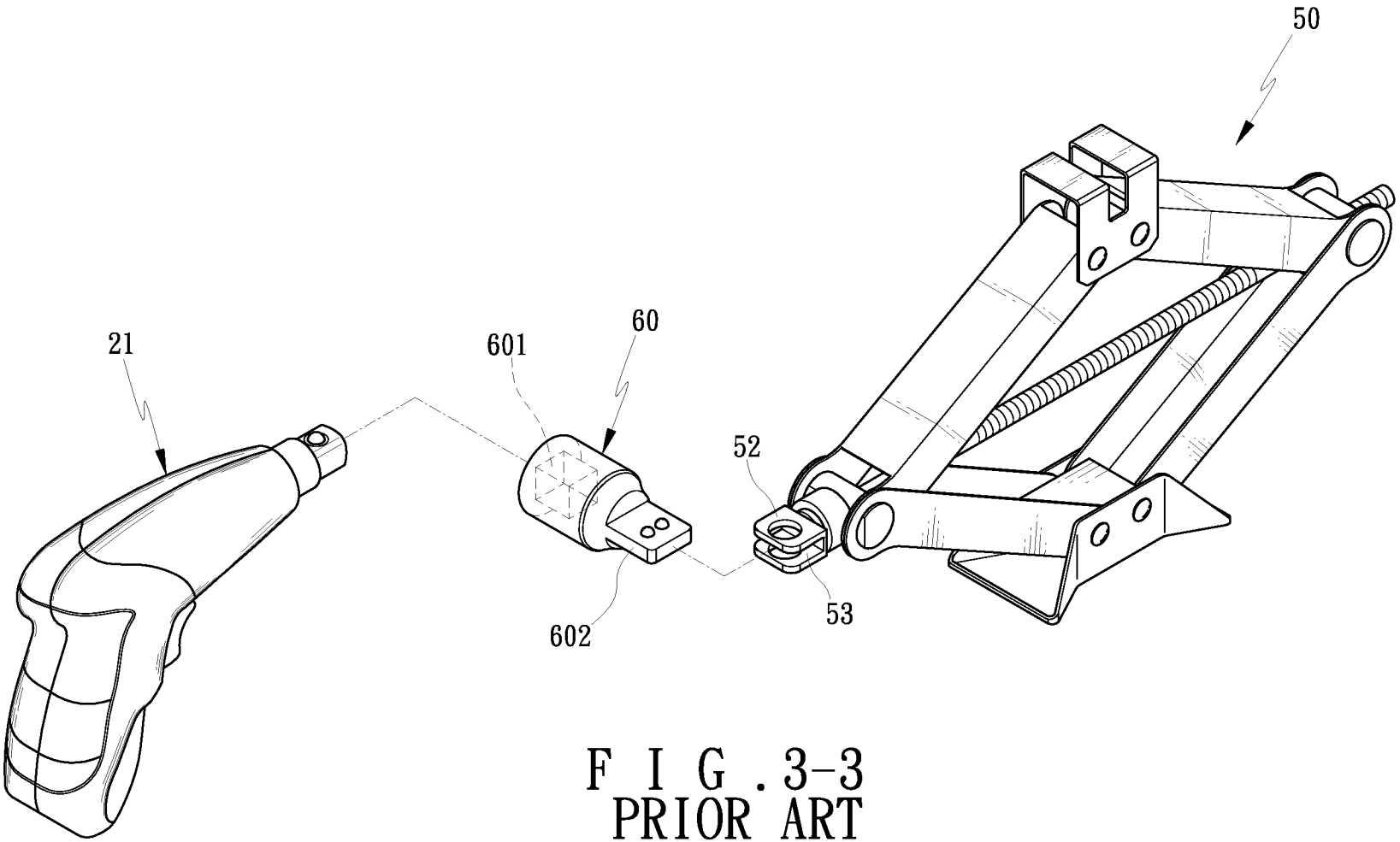
FIG. 3-3 PRIOR ART
Figure 4:
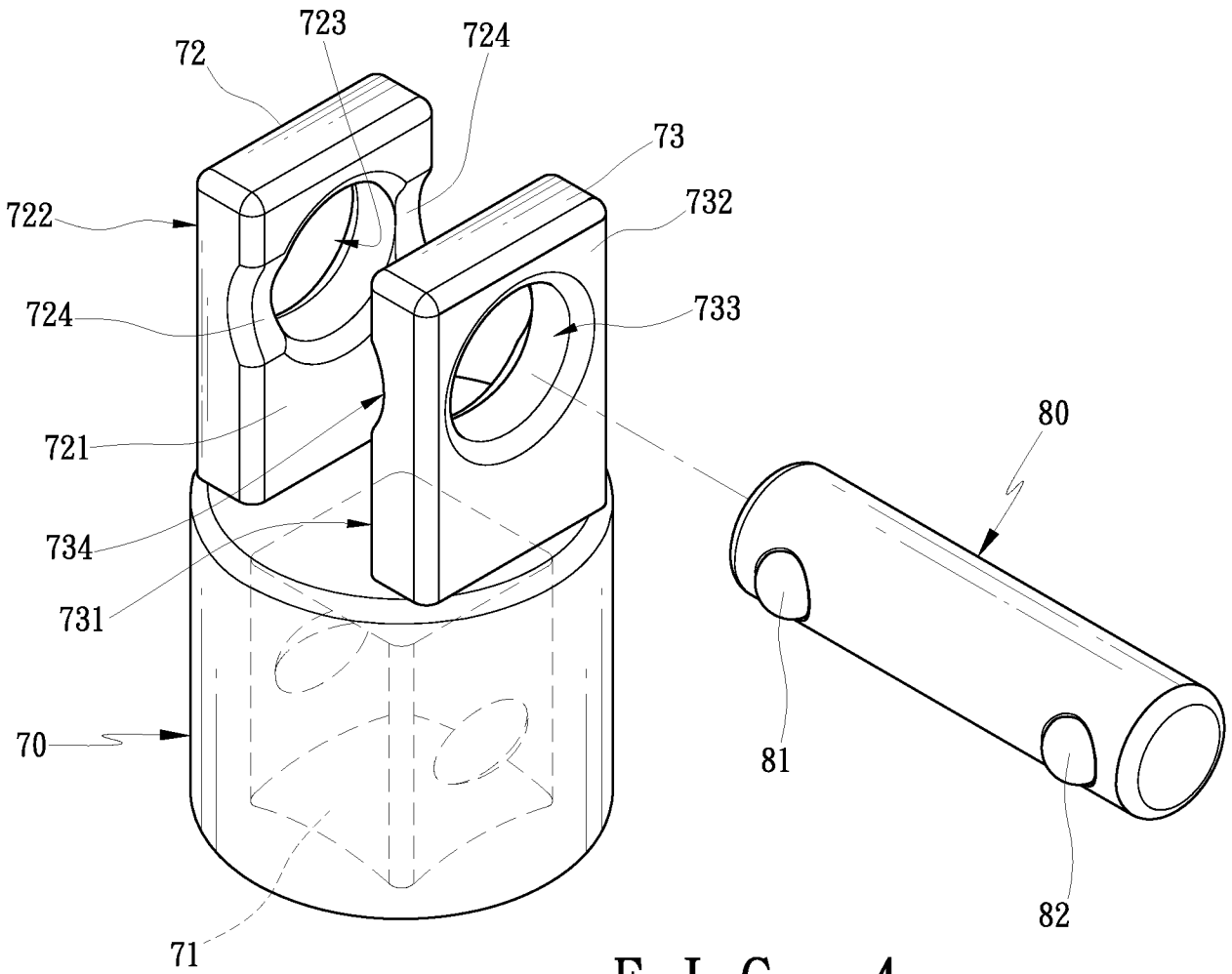
FIG. 4 is a perspective view showing the exploded components of a sleeve driving structure for various easy jacks according to a preferred embodiment of the present invention.
Figure 6:
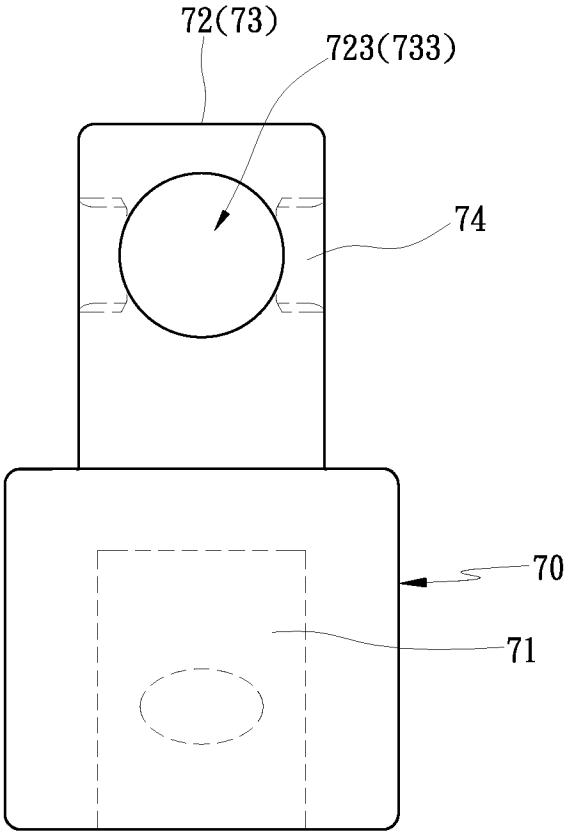
FIG. 6 is a side plan view showing the assembly of the sleeve body of the sleeve driving structure for various easy jacks according to the preferred embodiment of the present invention.
Figure 5:
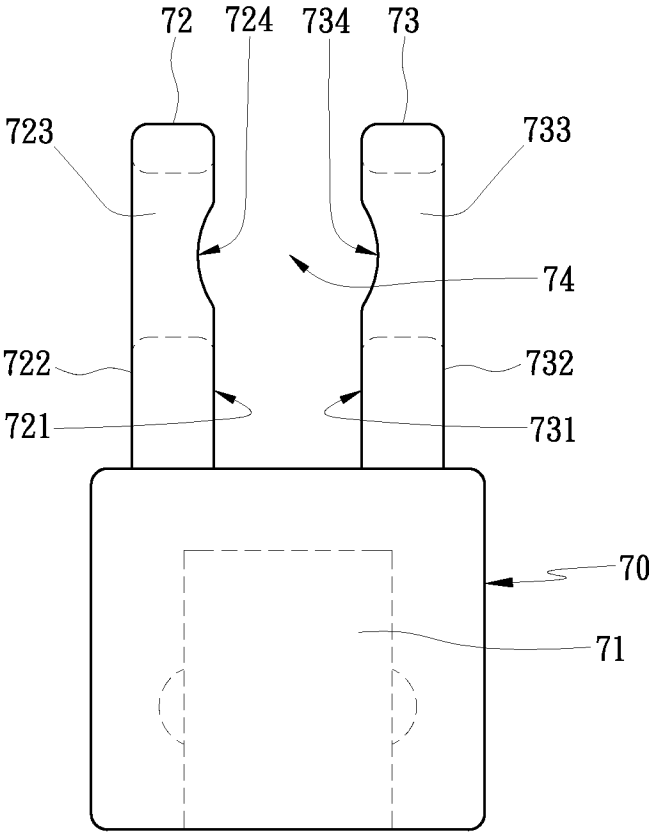
FIG. 5 is a front plan view showing the assembly of a sleeve body of the sleeve driving structure for various easy jacks according to the preferred embodiment of the present invention.

With reference to FIGS. 4-6, a sleeve driving structure according to a preferred embodiment of the present invention comprises: a sleeve body 70 and a bolt body 80. The sleeve body 70 includes a polygonal fitting portion 71 formed in a first end thereof so as to fit with a power rotating tool or a manual rotating tool. In this embodiment, the fitting portion 71 is a quadrangular hole. The sleeve body 70 also includes a first connecting extension 72 and a second connecting extension 73 symmetrically extending outward from two sides of a central axis line of a second end thereof, the first connecting extension 72 and the second connecting extension 73 are parallel to and separated a suitable distance from each other. In this embodiment, a first inner face 721 and a second inner face 731 of the first connecting extension 72 and the second connecting extension 73 are separated 9 mm from each other, and a first outer face 722 and a second outer face 732 of the first connecting extension 72 and the second connecting extension 73 are separated 19 mm from each other. Two widths of the first connecting extension 72 and the second connecting extension 73 are 15 mm, and the first connecting extension 72 and the second connecting extension 73 have a first orifice 723 and a second orifice 733 symmetrically communicating and concentric with each other and defined in a first direction thereof. In this embodiment, two diameters of the first orifice 723 and the second orifice 733 are 10 mm. The sleeve body 70 further includes a third orifice 74 defined at a central position of a second direction between the first inner face 721 and the second inner face 731 of the first connecting extension 72 and the second connecting extension 73. In this embodiment, a diameter of the first orifice 74 is 11 mm, and since a distance between the first inner face 721 and the second inner face 731 of the first connecting extension 72 and the second connecting extension 73 is 9 mm, the third orifice 73 has a first arc concave face 724 and a second arc concave face 734 formed on the first inner face 721 and the second inner face 731 of the first connecting extension 72 and the second connecting extension 73. The bolt body 80 is fitted in the first orifice 723 and the second orifice 733 of the first connecting extension 72 and the second connecting extension 73 or the third orifice 74. Also, the bolt body 80 includes an anti-remove element disposed on an end portion thereof. In this embodiment, the bolt body 80 is a circular bar and its diameter is 9.5 mm so that the bolt body 80 is fitted into the first orifice 723, the second orifice 733, and the third orifice 74. The bolt body 80 also includes two balls 81, 83 fixed in two ends thereof, wherein the two balls 81, 82 moves outwardly to prevent the bolt body 80 from disengagement from the first orifice 723 and the second orifice 733 or the third orifice 74.

Figure 7:
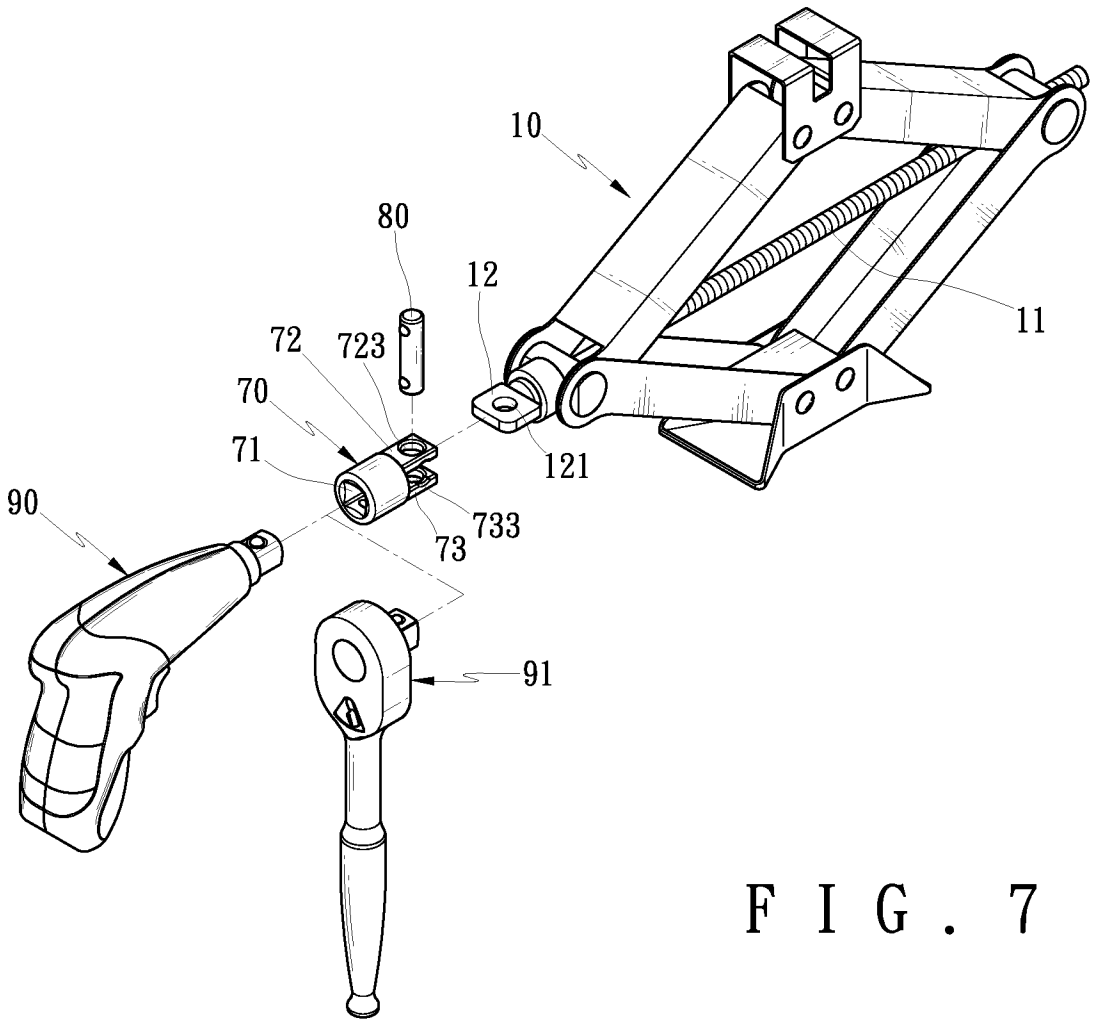
FIG. 7 is a perspective view showing the sleeve driving structure being used to match with a first type of easy jack.
Figure 8:
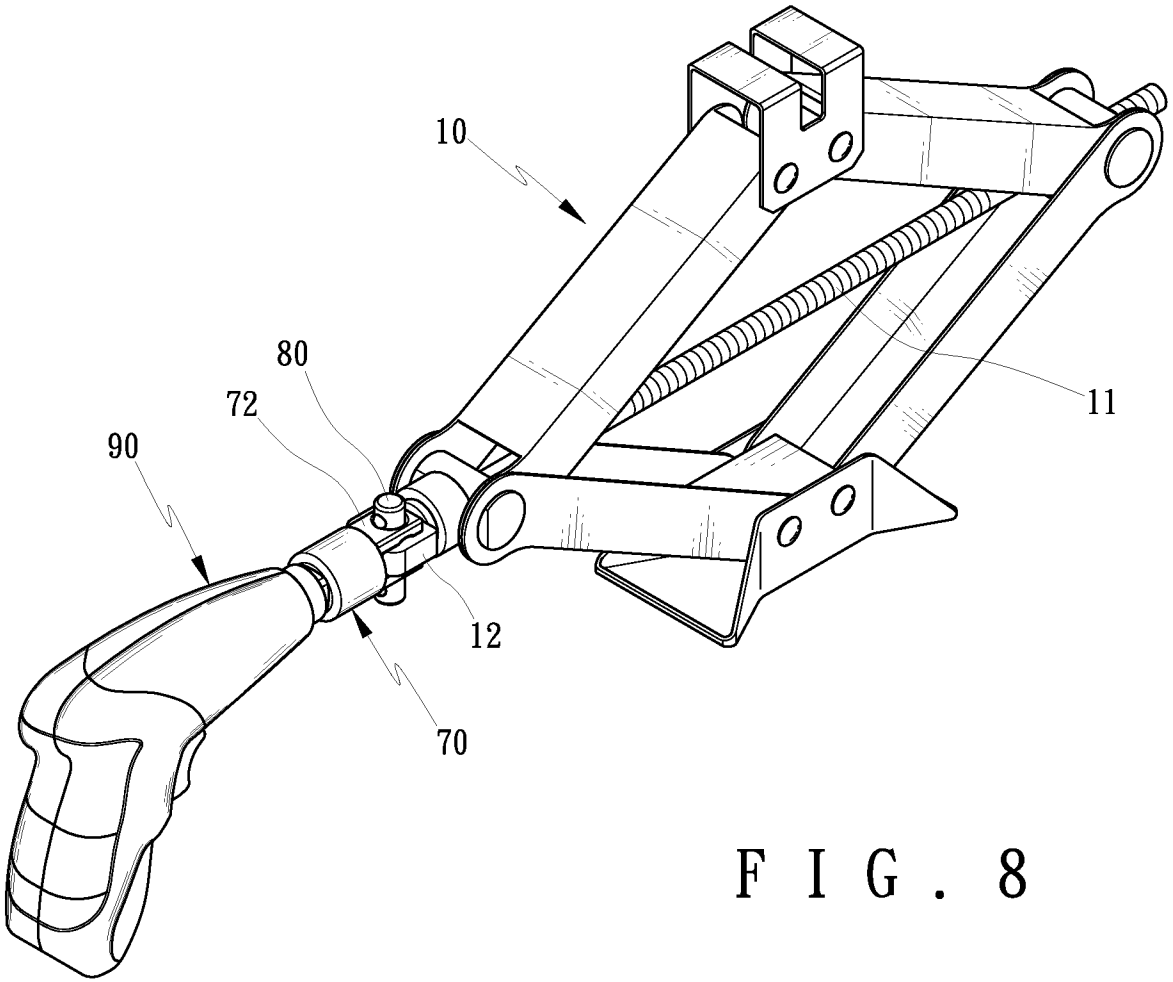
FIG. 8 is another perspective view showing the sleeve driving structure being used to match with the first type of easy jack.

With reference to FIGS. 5, 7, and 8, when the sleeve driving structure is used to match with the first type of easy jack 10, since the thickness of the single driving piece 12 on the end portion of the screw rod 11 of the easy jack 10 is 8 mm, and the distance between the first inner face 721 and the second inner face 731 of the first connecting extension 72 and the second connecting extension 73 is 9 mm, the single driving piece 12 is inserted between the first connecting extension 72 and the second connecting extension 73, and a central axis line of the sleeve body 70 connects with a central axis line of the screw rod 11, thereafter the bolt body 80 is fitted in the first orifice 723, the second orifice 733, and the aperture 121 of the single driving piece 12, such that the fitting portion 71 of the sleeve body 70 is fitted with a power rotating tool 90 (such as a pneumatic gun) or a manual rotating tool 91 (such as a ratchet wrench) to drive the sleeve body 70 to rotate, thus driving the first type of easy jack 10 stably.

Figure 9:
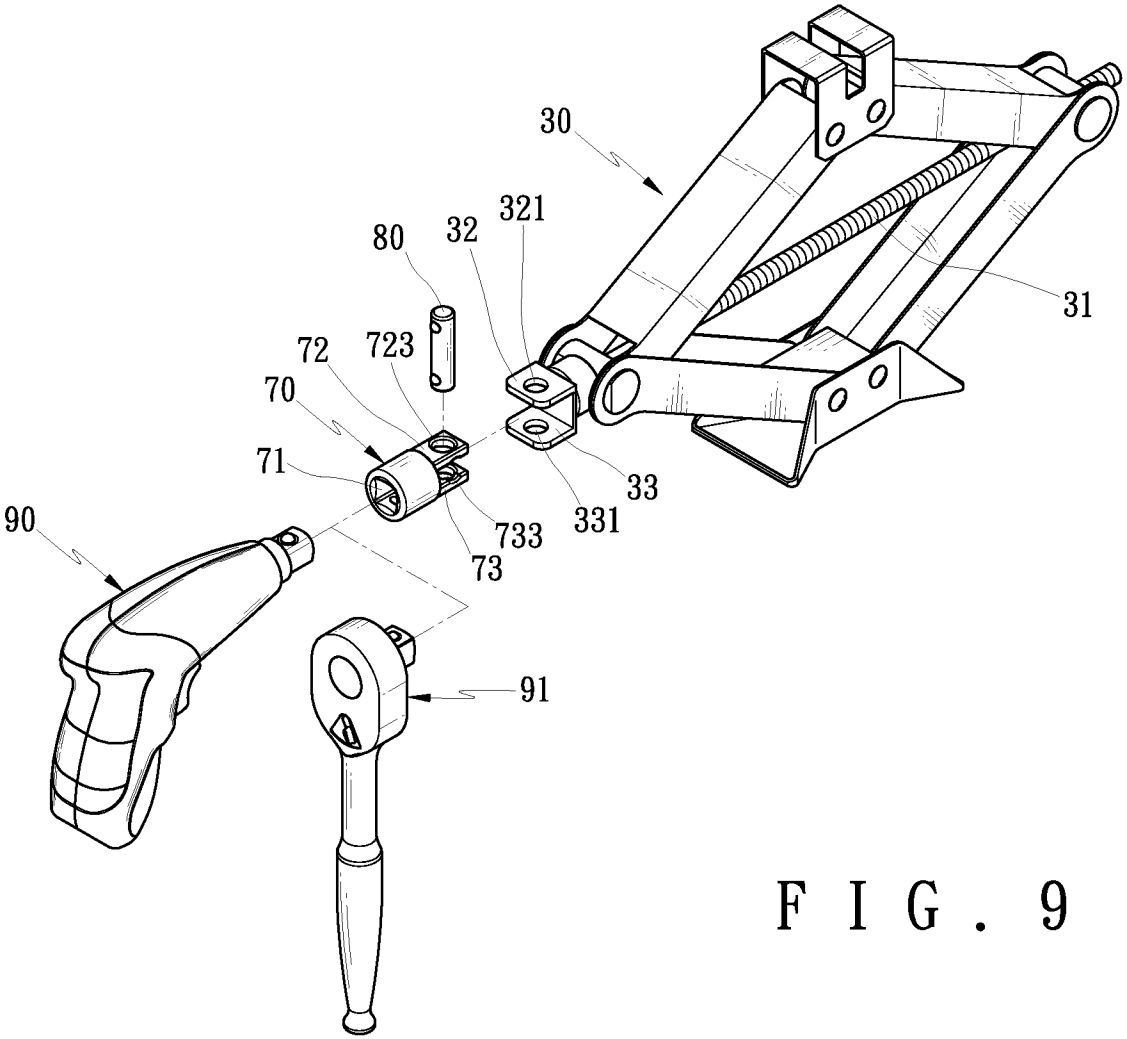
FIG. 9 is a perspective view showing the sleeve driving structure being used to match with a second type of easy jack.
Figure 10:
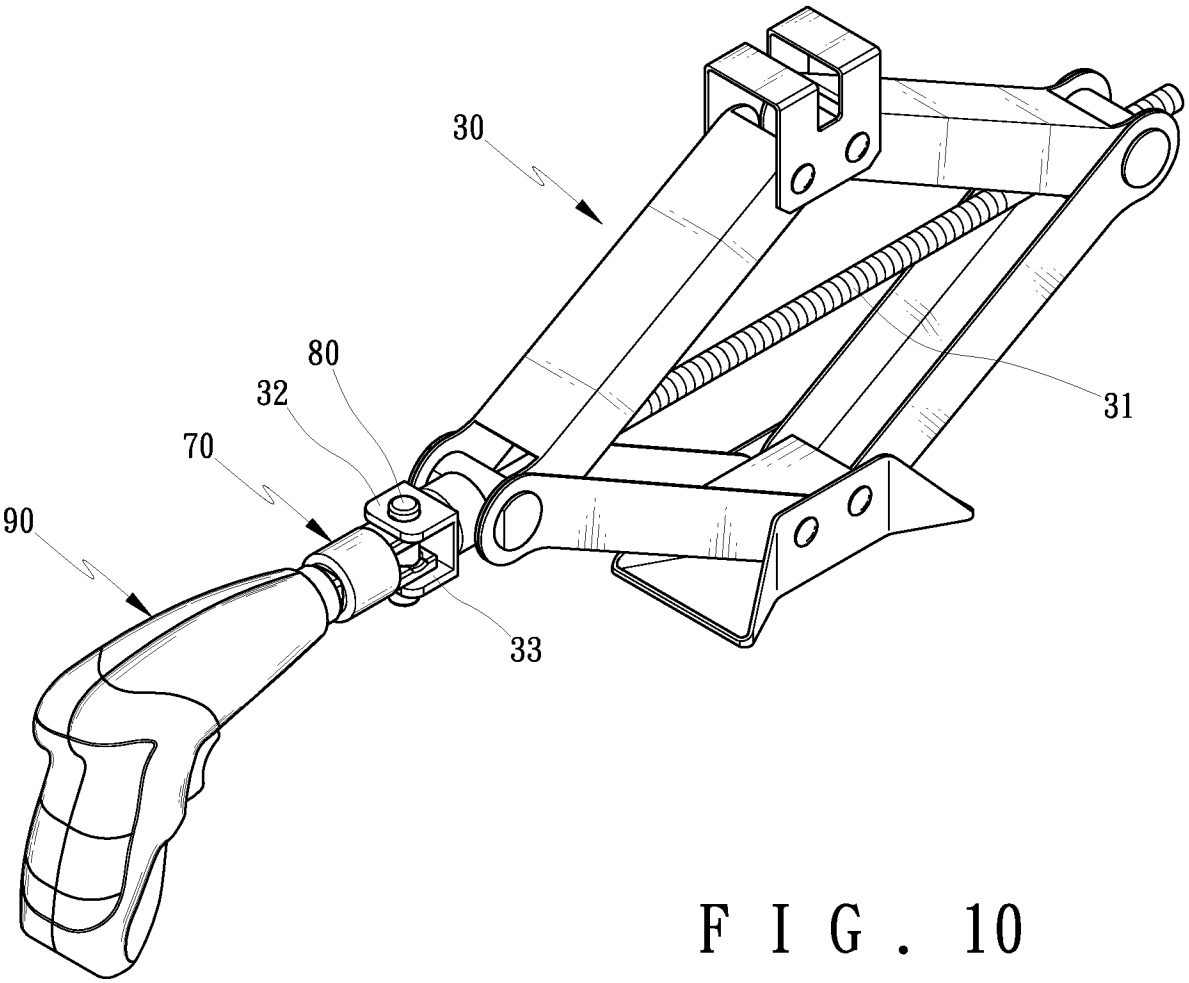
FIG. 10 is another perspective view showing the sleeve driving structure being used to match with the second type of easy jack.

Referring further to FIGS. 5, 9, and 10, when the sleeve driving structure is applied to cooperate with the second type of easy jack 30, since the two driving pieces 32, 33 are formed on the end portion of the screw rod 31 of the easy jack 30, the distance between the two driving pieces 32, 33 is 20-22 mm, and the two driving pieces 32, 33 have the two symmetrical apertures 321, 331 defined thereon and communicating and concentric with each other, a distance between the first outer face 722 and the second outer face 732 of the first connecting extension 72 and the second connecting extension 73 is 19 mm, such that the first connecting extension 72 and the second connecting extension 73 of the sleeve body 70 are inserted between the two driving pieces 32, 33 of the screw rod 31, and the central axis line of the sleeve body 70 connects with a central axis line of the screw rod 31, thereafter the bolt body 80 is fitted in the first orifice 723, the second orifice 733, and the two symmetrical apertures 321, 331 of the two driving pieces 32, 33, such that the fitting portion 71 of the sleeve body 70 is fitted with the power rotating tool 90 (such as the pneumatic gun) or the manual rotating tool 91 (such as the ratchet wrench) to drive the sleeve body 70 to rotate, thus driving the second type of easy jack 30 stably.

Figure 11:
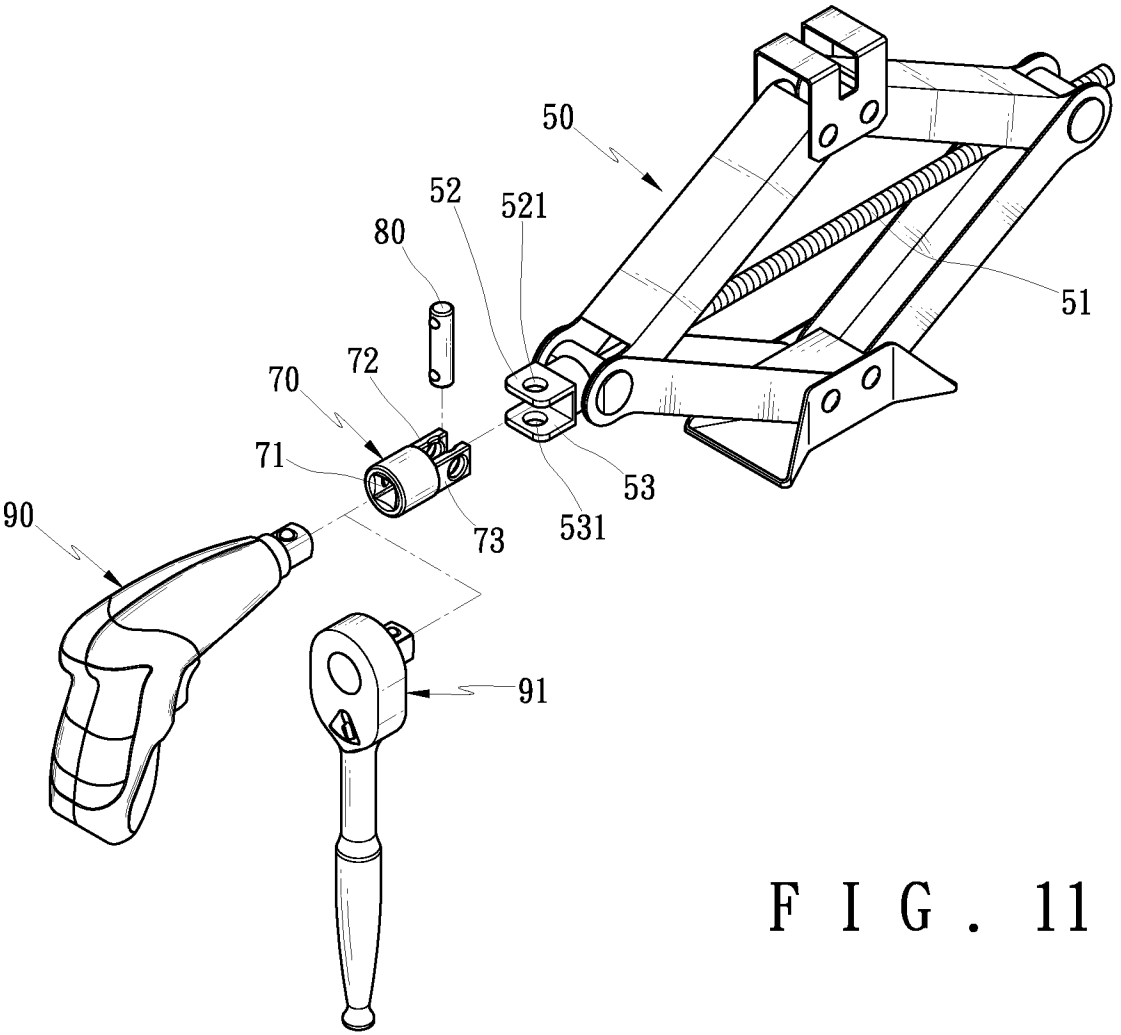
FIG. 11 is a perspective view showing the sleeve driving structure being used to match with a third type of easy jack.
Figure 12:
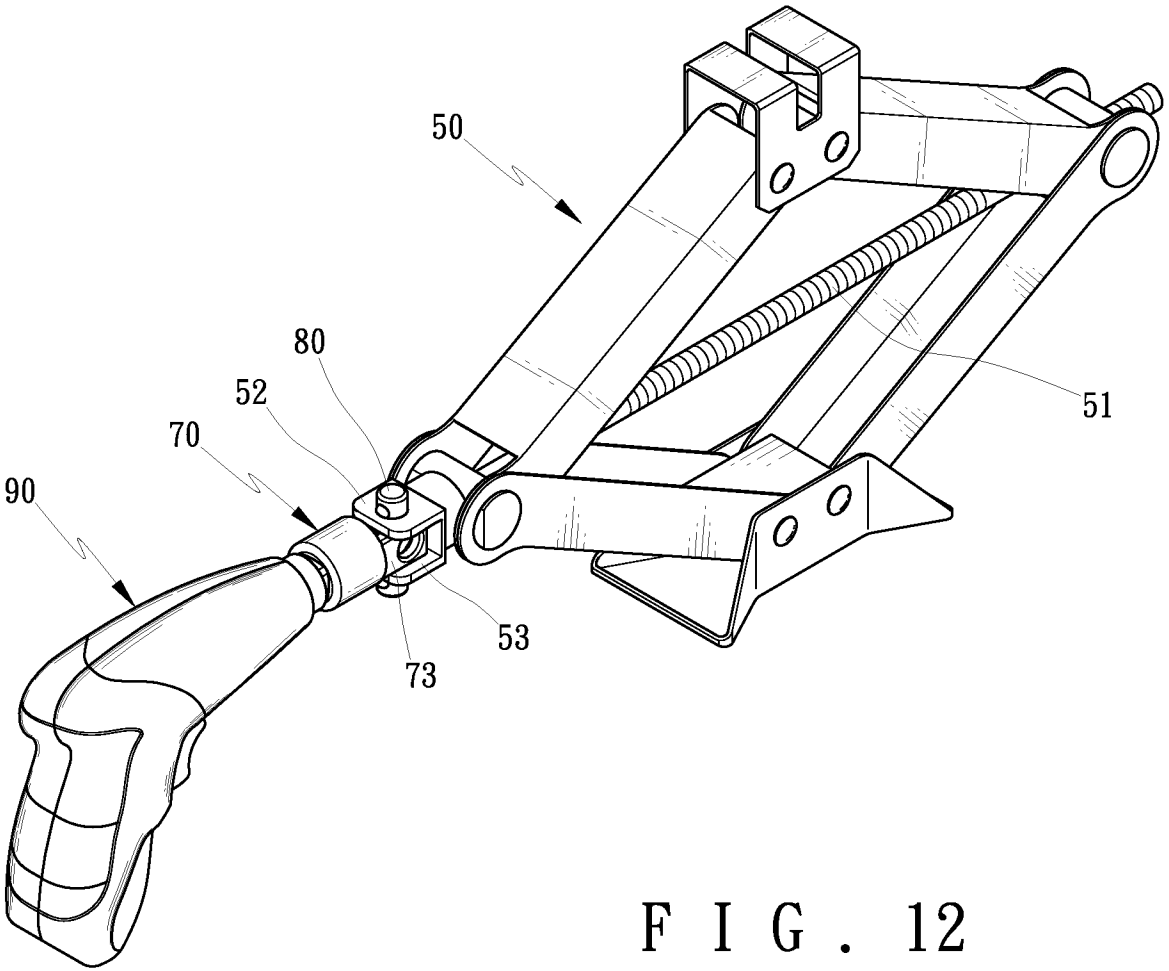
FIG. 12 is another perspective view showing the sleeve driving structure being used to match with the third type of easy jack.

Referring further to FIGS. 5, 11, and 12, when the sleeve driving structure is served to cooperate with the third type of easy jack 50, since the two driving pieces 52, 53 are formed on the end portion of the screw rod 51, the distance between the two driving pieces 52, 53 is 16 mm, and because the distance between the first outer face 722 and the second outer face 732 of the first connecting extension 72 and the second connecting extension 73 is 19 mm, the first connecting extension 72 and the second connecting extension 73 of the sleeve body 70 can not inserted between the two driving pieces 52, 53 of the screw rod 51, in the meantime time, the sleeve body 70 is rotated 90 degrees, and due to the two widths of the first connecting extension 72 and the second connecting extension 73 are 15 mm, the first connecting extension 72 and the second connecting extension 73 are horizontally inserted between the two driving pieces 52, 53 of the screw rod 51, and the central axis line of the sleeve body 70 connects with a central axis line of the screw rod 51, thereafter the bolt body 80 is fitted in the third orifice 74 and the two symmetrical apertures 521, 531 of the two driving pieces 52, 53, such that the fitting portion 71 of the sleeve body 70 is fitted with the power rotating tool 90 (such as the pneumatic gun) or the manual rotating tool 91 (such as the ratchet wrench) to drive the sleeve body 70 to rotate, thus driving the third type of easy jack 50 stably.

Thereby, the sleeve driving structure allows matching with the first type of easy jack with the single driving piece, the second type of easy jack with the two driving pieces, or the third type of easy jack with the two driving pieces so that various easy jacks are driven by the power rotating tool or the manual rotating tool to move upwardly or downwardly, and the central axis line of the sleeve body connects with the central axis lines of the screw rods of the various easy jacks, thus operating the sleeve body stably.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A sleeve driving structure for various easy jacks comprising:

a sleeve body including a polygonal fitting portion formed in a first end thereof so as to fit with a rotating tool and including a first connecting extension and a second connecting extension symmetrically extending outward from a second end thereof, the first connecting extension and the second connecting extension being parallel to and separated a suitable distance from each other so as to insert at least one driving piece of a screw rod of a jack, and the first connecting extension and the second connecting extension having a first orifice and a second orifice symmetrically communicating and concentric with each other and defined in a first direction thereof;

a bolt body fitted in the first orifice and the second orifice of the first connecting extension and the second connecting extension and at least one aperture of the at least one driving piece of the jack.

2. The sleeve driving structure for various easy jacks as claimed in claim 1, wherein the fitting portion is a quadrangular hole so as to fit with a power rotating tool or a manual rotating tool.

3. The sleeve driving structure for various easy jacks as claimed in claim 1, wherein the sleeve body includes the first connecting extension and the second connecting extension symmetrically extending outward from two sides of a central axis line of the second end thereof.

4. The sleeve driving structure for various easy jacks as claimed in claim 3, wherein a first inner face and a second inner face of the first connecting extension and the second connecting extension are separated mm from each other, and a first outer face and a second outer face of the first connecting extension and the second connecting extension are separated mm from each other, two widths of the first connecting extension and the second connecting extension are 15 mm.

5. The sleeve driving structure for various easy jacks as claimed in claim 3, wherein two diameters of the first orifice and the second orifice are 10 mm.

6. The sleeve driving structure for various easy jacks as claimed in claim 1, wherein the sleeve body further includes a third orifice defined at a central position of a second direction between the first inner face and the second inner face of the first connecting extension and the second connecting extension.

7. The sleeve driving structure for various easy jacks as claimed in claim 6, wherein a diameter of the first orifice is 11 mm, and the first inner face of the first connecting extension has a first arc concave face formed thereon, and the second inner face of the second connecting extension has a second arc concave face formed thereon.

8. The sleeve driving structure for various easy jacks as claimed in claim 7, wherein bolt body is fitted in the third orifice between the first connecting extension and the second connecting extension and the at least one aperture of the at least one driving piece of the jack.

9. The sleeve driving structure for various easy jacks as claimed in claim 1, wherein the bolt body is a circular bar and includes two balls fixed in two ends thereof.

* * * * *